United States Patent [19]

DeSpain

[11] Patent Number: 4,991,360

[45] Date of Patent: Feb. 12, 1991

[54] METHOD AND APPARATUS FOR SURFACE TREATING A WORKPIECE

[75] Inventor: James R. DeSpain, Prospect, Ky.

[73] Assignee: Carrier Vibrating Equipment, Inc., Louisville, Ky.

[21] Appl. No.: 223,336

[22] Filed: Jul. 25, 1988

[51] Int. Cl.[5] ..... B24B 31/06

[52] U.S. Cl. ..... 51/317; 51/7; 51/163.1; 51/313; 51/17

[58] Field of Search ..... 51/7, 17, 163.1, 313, 51/317

[56] References Cited

U.S. PATENT DOCUMENTS

| | | | |
|---|---|---|---|
| 3,142,939 | 8/1964 | Booker | 51/16 |
| 4,499,692 | 2/1985 | Balz | 51/163.1 |
| 4,581,853 | 4/1986 | Marcus | 51/7 |

*Primary Examiner*—Frederick R. Schmidt
*Assistant Examiner*—Jack Lavinder
*Attorney, Agent, or Firm*—Jon C. Winger

[57] ABSTRACT

A method for surface treating a continuous flow of workpieces includes the steps of fluidizing a stationary bed of surface treating media, aggitating the fluidized bed of surface treating to create a scrubbing action to the surface treating media, suspending the workpieces from an overhead conveyor located over the bed of surface treating media and moving the workpieces to be treated suspended from the overhead conveyor through the stationary, fluidized aggitated media bed subjecting the workpieces to the scrubbing action of the media. Further, an apparatus for surface treating workpieces which includes a reservoir for containing a bed or pool of surface treating media, a force vibration generating device for imparting a reciprocating force to the reservoir and therefore, the surface treating media contained in the reservoir, the reciprocating force having at least a vertical vector and an overhead conveyor means located over the reservoir for conveying the workpieces to be treated continuously through the reservoir and, therefore, through the media.

12 Claims, 2 Drawing Sheets

METHOD AND APPARATUS FOR SURFACE TREATING A WORKPIECE

BACKGROUND OF THE INVENTION

1. Field of the Invention

The present invention relates to a method and apparatus for surface treating the surfaces of a workpiece, more particularly, to a method and apparatus wherein the workpieces to be surface treated are continuously moved through a bed of aggitated surface treating media.

2. Discussion of the Prior Art

Various processes and apparatus are known to the art for surface treating workpieces. Examples are shown in the following U.S. Patents.

U.S. Pat. No. 2,815,609 issued on Dec. 20, 1957 shows an apparatus for deburring and polishing workpieces including a pan which holds deburring material such as steel balls o stones. The pan is mounted in a stationary frame for vertical reciprocating movement by means of sprockets and chains supported on the frame. The apparatus includes a shaft which is mounted to the frame over the pan and is moved in a reciprocating motion along its longitudinal axis by means of an eccentric. The workpiece to be deburred is clamped to the reciprocating shaft to depend therefrom, and the pan is raised so that the workpiece is submerged in the deburring material. The shaft is then reciprocated to move the workpiece back and forth through the deburring material. After a sufficient time, the pan is lowered and the workpiece is removed from the deburring material, and the deburred workpiece is removed from the shaft.

U.S. Pat. No. 2,918,926 issued on Dec. 29, 1959 shows a washing and degreasing apparatus which includes a large tank for holding a suitable liquid cleaning solution. A parts basket having perforated walls is suspended into the liquid solution in the tank. The parts basket has one open end, and is mounted on springs for vibrator and oscillatory motion. A vibration generating device which includes an electric motor is connected to the parts basket by means of a belt to impart a vibratory motion to the basket. In addition, a sloped endless conveyor is located within the tank so that a portion of the conveyor lies below the open end of the parts basket to receive the parts from the basket and convey the parts out of the tank. Parts to be cleaned are deposited in the basket near the end thereof opposite the open basket end so that they are immersed in the cleaning solution. The basket is then caused to vibrate so that the parts therein will be moved toward the open basket end and be discharged onto the endless conveyor for removal from the tank.

U.S. Pat. No. 3,045,397 issued on July 24, 1962 shows an apparatus for surface treating parts which includes a support frame mounted on springs and an electric motor connected to the support frame through a belt system for imparting a vibratory action to the support frame. The apparatus further includes a plurality of parts receiving vats rigidly mounted to the support frame. The parts to be treated as well as liquid treating agent are place in the vats, and the frame is vibrated.

U.S. Pat. No. 3,128,577 issued on Apr. 14, 1964 shows an apparatus for deburring articles of considerable length which includes a tank containing abrasive material. Vibrator devices are attached to the outer side of the floor of the tank to vibrate the abrasive material in the tank. The opposite end walls of the tank have aligned apertures for accommodating the longitudinal movement of an elongated article to be deburred through the tank. The apertures have seals to prevent abrasive material from leaking out of the tank. Powered, article feed rollers are located outside the tank at one end wall. The elongated article to be deburred is inserted longitudinally through the apertures in the tank end walls and is engaged by the feed rollers. The feed rollers move the elongated article through the tank wherein it is subjected to the vibrating abrasive material and is deburred thereby.

U.S. Pat. No. 3,148,483 issued on Sept. 15, 1964 shows a machine for the surface treatment of an article by the reaction of media in vibratory movement which includes a rigid base with a horizontal table resiliently supported on the base by coil springs and a trough containing particulate treating material is secured to the table. Vibratory movement is imparted to the table, and therefore to the trough, by means of an eccentric drive arrangement located in the base below the table. The elongated trough has an upstream end wall, spaced apart side walls, a concave floor, and is open at the downstream end. A perforated platform is located at the open downstream or outlet end of the trough to separate particulate media exiting the trough from the treated articles also exiting the trough. The separated media is returned to the upstream end of the trough through an inlet chute for reuse in the treatment of further articles placed in the trough.

U.S. Pat. No. 3,336,701 issued on Aug. 22, 1967 shows a elongated, downwardly inclined container box containing an abrasive particulate material. The elongated, sloped container box is suspended on air cushions on fixed legs. Vibration is imparted to the container box by means of driven shafts and eccentric weights located beneath the container box. Articles to be finished are loaded into the container box by a chute located at the elevated container end. The lower end of the container box includes a lip over which finished articles and particulate treating material overflow from the container box. A screen arrangement is positioned beneath the container lip outside the container box for separating finished articles from the abrasive particulate material. The particulate material passes through the screen onto a recycling conveyor which returns particulate material back to the container box for reuse.

U.S. Pat. No. 4,258,505 issued on May 31, 1981 shows another apparatus for cleaning a workpiece with abrasive particulate material which includes a closed vessel. A grate is located within the vessel above the vessel floor. A bed of abrasive material is located above and supported on the grate, and the volume beneath the grate forms a plenum chamber. Compressed air is introduced into the plenum chamber and passes upwardly through the grate to maintain the abrasive material in a fluid and agitated state. The two end walls of the vessel are formed with openings through which a continuous elongated workpiece is moved through the bed of abrasive material. In addition, air conduits are located through the bed of abrasive material next to the path of the elongated workpiece passing through the abrasive material bed. These air conduits have nozzles oriented to direct compressed air streams against the surface of the workpiece moving through the abrasive material bed. The air issuing from these nozzles pick up particles from the fluidized bed and propels the abrasive particles at high velocity against the surface of the workpiece. A mixture of air and abrasive material rising from the abrasive bed is removed from the vessel through an exhaust duct to a separator device. The separator device separates particulate material from the air. The separated particulate material is returned to the vessel for reuse, and the separated air is exhausted to the atmosphere.

U.S. Pat. No. 4,586,293 issued on May 6, 1986 shows a vibratory surface treating apparatus and method wherein a reservoir containing a bed of surface treating media is vibrated to fluidize and agitate the bed of surface treating media and workpieces to be surface treated are caused to move through the bed of surface treating media under the influence of the vibrations imparted to the reservoir. In another embodiment, this patent shows an endless belt conveyor system submerged within the bed of surface treating media for moving the workpieces through the media bed.

U.S. Pat. No. 4,662,425 issued on May 5, 1987 shows a batch type vibratory scrubbing apparatus which includes a container filled with particulate scrubbing media and vibratory generators for vibrating the container and scrubbing media. A part or casting structure is suspended by a chain above the container, and a part or casting is fastened to the bottom end of the support structure. Additional vibration generators are connected to the support structure. In operation, the support structure with the part or casting attached is lowered to locate the part or casting into the vibratory particulate media. The support structure is then raised to remove the part or casting from the particulate media.

SUMMARY OF THE INVENTION

The present invention provides a method and an apparatus for the continuous surface treating of workpieces.

The present invention further provides a method and apparatus for the continuous surface treating of workpieces which can be intermixed of workpieces of various different sizes and shapes without any modification to the method or apparatus.

The present invention further provides a method and apparatus of the class described wherein the exterior surface and any open internal voids of the workpiece are concurrently surface treated.

More particularly, the present invention in one embodiment provides a method of surface treating workpieces comprising the steps of vibrating a bed of a surface treating media sufficiently for fluidizing the bed of surface treating media, suspending workpieces from above the fluidized bed of surface treating media such that the workpieces are submerged in the fluidized bed of surface treating media, and continuously conveying the workpieces through the fluidized bed of surface treating media.

The present invention further provides an apparatus for surface treating workpieces, comprising means defining a reservoir for containing a bed of surface treating media, vibrating means for imparting a vibratory force to the reservoir defining means for fluidizing the bed of surface treating media in the reservoir, conveyor means located above the reservoir, and means for suspending the workpieces from the conveyor means such that the workpieces are submerged in the bed of surface treating media in the reservoir means.

BRIEF DESCRIPTION OF THE DRAWINGS

The various features and advantages of the present invention will become even more clear upon reference to the following discussion in conjunction with the accompanying drawings wherein like numerals refer to like parts through and in which.

DETAILED DESCRIPTION OF THE PREFERRED EMBODIMENT

Figure 1:
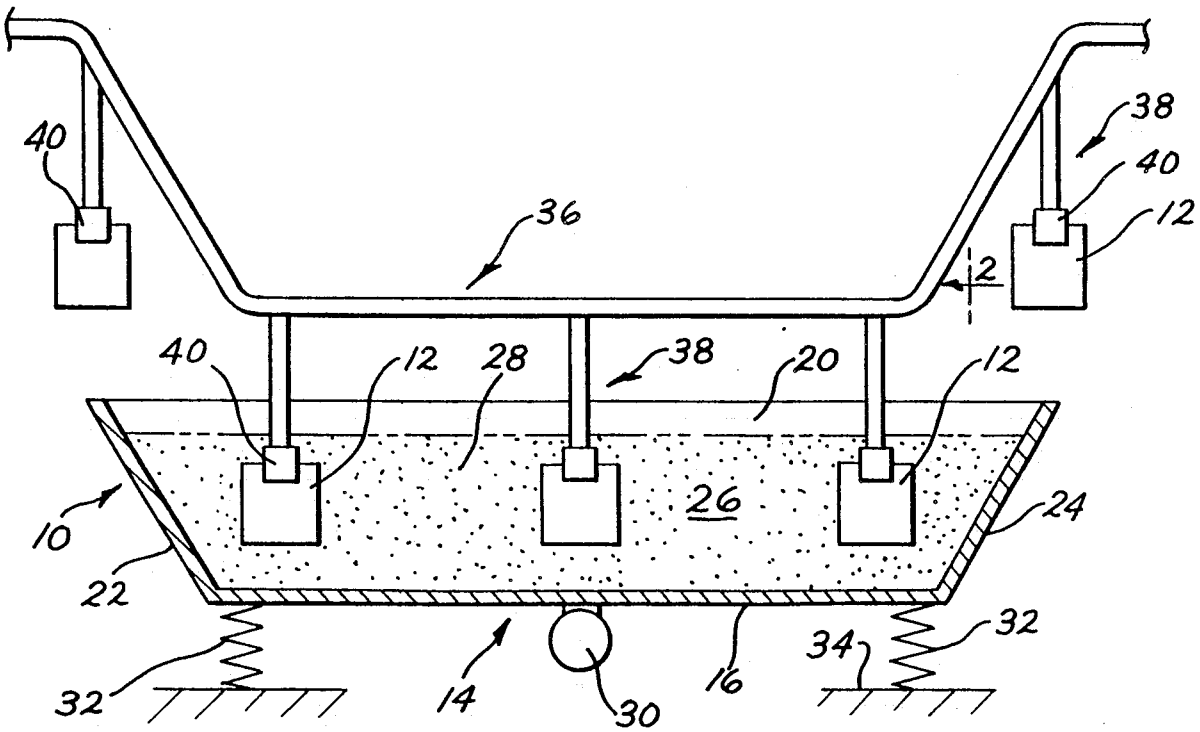
FIG. 1 is a side view of one advantageous embodiment of the present invention with portions broken out to more clearly show internal features.
Figure 2:
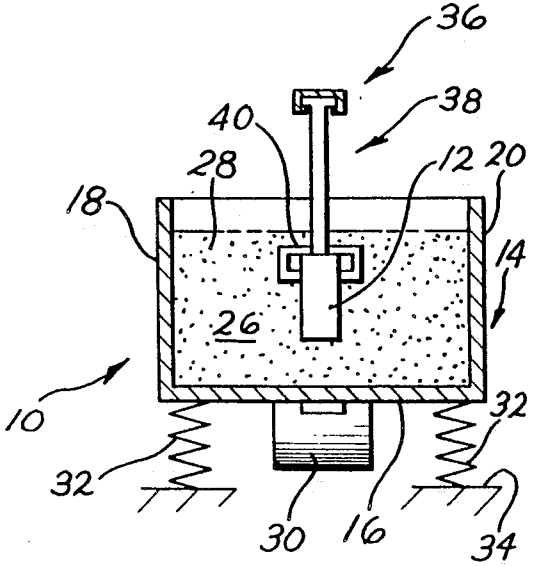
FIG. 2 is an end view of FIG. 1 as viewed in the direction of arrows 2—2 in FIG. 1.

With reference to FIGS. 1 and 2, there is shown an apparatus of the present invention, generally denoted as the numeral 10, for surface treating workpieces 12. The workpieces to be surface treated can be virtually any article of manufacture. Examples of the types of surface treatment for which the apparatus 10 can be used include, but are not limited to, deburring, polishing, burnishing and cleaning of the workpieces.

The apparatus 10 includes an elongated housing, generally denoted as the numeral 14, which comprises a floor 16, two spaced apart generally parallel side walls 18 and 20, and two spaced apart generally parallel end walls 22 and 24. The floor 16, side walls 18, and 20, and parallel end walls 22 and 24 cooperate to define a workpiece treating media reservoir 26.

The end wall 22 constitutes the workpiece entrance end of the reservoir 26 and the other end wall 24 constitutes the workpiece exit end of the reservoir 26. The reservoir 26 is filled with a bed of appropriate workpiece surface treating media 28. It is presently contemplated that the surface treating media 28 will be particulate material, or particulate material and liquid. The exact nature of the surface treating media will, of course, depend upon the type of surface treatment to be carried out, and upon the material of the workpieces 12. By way of example, the particulate material could be sand, stone, steel shot, and the liquid could be an oil or a solvent such as water.

The apparatus 10 further includes vibrating means, generally denoted as the numeral 30, for causing the housing 14, and therefore the bed of surface treating media 28, to vibrate. The vibratory forces created by the vibratory means 30 have an amplitude and frequency sufficient to overcome the settling velocity of the media 28 due to gravity so that the media 28 is fluidized, that is so that the media 28 has a low resistance to flow. The vibrating means 30 can be virtually any known or otherwise convenient device such as, for example, an eccentric drive arrangement, or rotating unbalanced mass device. Even further, the vibrating means 30 can be of the variable frequency type which provides for selectively varying the frequency of the force generated thereby from a minimum to a maximum so that the frequency of the generated forces can be changed as the type of surface treating media, workpiece material, or surface treating parameters may change. In addition, the vibrating means 30 can impart only a vertical force vector to the housing 14, or impart both a vertical force vector component and a horizontal force vector component to the housing 14.

The housing 14 is preferably mounted on vibration isolation means 32 to isolate the vibrating housing 14 from its environment. Various isolation means are well known and include, but are not limited to gas filled bags, liquid filled devices, resilient pads and leaf springs. As shown in FIG. 1, the housing 14 is isolated from the floor 34 of a facility in which it is placed by isolation means in the form of coil springs.

The apparatus 10 further includes a powered overhead workpiece moving or conveying means, generally denoted as the numeral 36, located over the housing 14 extending along the longitudinal axis of the housing 14. The conveyor means 36 descends at the entrance end 22 of the housing 14 to a lower elevation above the bed of surface treating media 28, transverses the housing 14 at this lower elevation, and ascends at the exit end 24 of the housing 14. Workpiece suspension means, generally denoted as the numeral 38 depend from the overhead workpiece conveying means 36 at spaced apart intervals therealong and are affixed thereto for movement with the conveying means 36. Workpiece supporting means, generally denoted as the numeral 40, is located at the distal end of the workpiece suspension means 38 for affixing the workpieces to be treated to the suspension means 38 and, therefore, to the conveying means 36 so that the workpiece 12 moves with the conveying means 36. The suspension means 38 is of a sufficient depending length so that the workpiece 12 attached at its distal end will be above the elevation of the housing 14 as the conveying means 36 carries the workpieces 12 to and from the housing 14 but will be submerged in the bed of surface treating media 28 in the reservoir 26 as the conveying means 36 transverses the housing 14. As shown, the conveying means 36 is a continuous monorail conveyor of the carousel type so that suspension means 38 are continuously moving through the reservoir 26. Also as shown, the suspension means 38 are rigid members, for example, steel I-beams or the like. The design of the supporting means 40 will depend upon the physical configuration and material properties of the workpiece 12, but is illustrated as a clamp arrangement gripping opposite lateral sides of the workpieces 12.

In operation, at a workstation (not shown) upstream of the housing 14 workpieces 12 to be surface treated are positioned in the workpiece supporting means 40 so that the overhead conveying means 36 moves a continuous supply of workpieces to the housing 14. As the conveying means 36 descends, the workpieces 12 suspended therefrom submerge into the bed of fluidized surface treating media 28 in the reservoir 26 of the housing 14, and are moved through the bed of surface treating media 28 in the longitudinal direction of the housing 14. Because the workpieces 12 are held in the rigid workpiece suspension means 38 there is a relative motion between the fluidized and vibrating surface treating media and the workpiece 12 resulting in a scrubbing action of the surface treating media on the workpieces 12.

Figure 4:
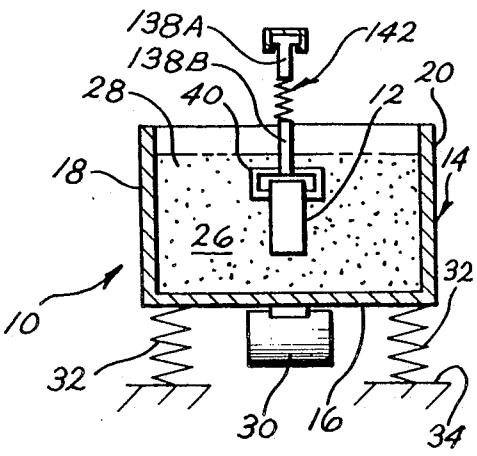
Figure 3:
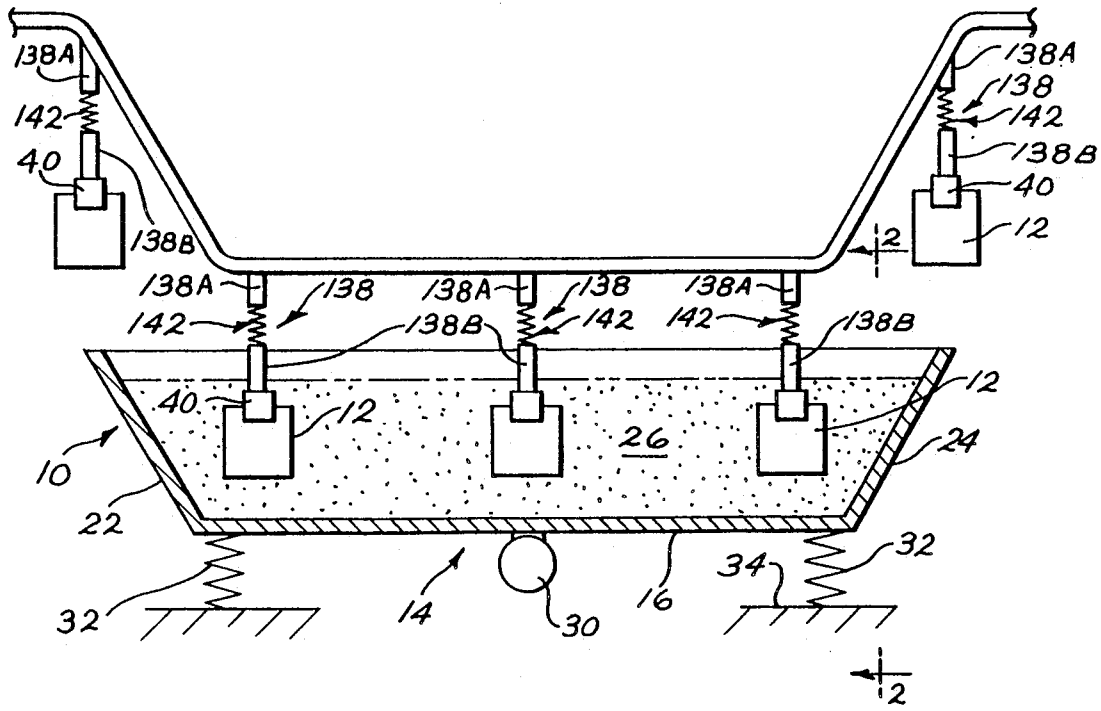
FIG. 3 is a side view of another advantageous embodiment of the present invention with portions broken away to more clearly show internal features; and, FIG. 4 is an end view of FIG. 3 as viewed in the direction of arrows 3—3 in FIG. 4.

Now with reference to FIGS. 3 and 4, there is shown another embodiment of an apparatus of the present invention, generally denoted as the numeral 110, for surface treating workpieces 12. The apparatus 110 is identical in most respects to the apparatus 10 of FIGS. 1 and 2, and the common features are denoted by identical numerals. Therefore, for the sake of brevity and clearness of understanding, the description of these common features will not be repeated.

The difference between the apparatus 10 and the apparatus 110 resides in the workpiece suspension means which is denoted generally as the numeral 138 in FIGS. 3 and 4 to differentiate it from the suspension means 38 of the apparatus 10 in FIGS. 1 and 2.

The suspension means 138 is not rigid as is the suspension means 38, but includes a tension isolation device 142. The tension isolution device 142 can be positioned at various locations above the workpiece supporting means 40. For example, the isolution device 142 could be located between the distal end of the suspension means and the workpiece supporting means 40 or between the proximal end of the suspension means 38 and the conveying means 36. However, as shown, the suspension means 36 is divided into two components 36A and 367B and the isolation device 142 is located between and interconnecting these two suspension means components 36A and 36B. The isolation means 142 are resilient members such as, for example, elastomeric bodies, pneumatic bodies, and the like. As shown, the isolation device 142 includes a tension spring such as coil spring. The isolation device 142 is selected to either cause the suspended workpiece 12 to vibrate out of phase with the vibrating surface treating media 28, or alternatively, to vibrate in phase with the vibrating surface treating media 28 at the same frequency, but at a greater amplitude. In either of these operating modes, there is produced a relative motion between the workpiece 12 and the vibrating surface treeating media 28 which provides a scrubbing action of the surface treating media on the workpieces. The isolation device 142 can be selected so that the resonent frequency of the combined mass of the suspension means 38 and supporting means 40 and workpiece 12 closely matches the frequency of the vibrating means 30 used to vibrate the housing 14 and bed of surface treating media.

In operation of the apparatus 110, when the workpieces 12 are suspended by the workpiece suspension means 138 in the bed of surface treating media 28 the vibrating surface treating media 28 excites a sympathic vibration in the isolatiion device 142 which causes the workpiece 12 to vibrate as described above relative to the vibrating bed of surface treating media 28 creating a scrubbing action of the surface treating media 28 on the workpiece 12.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. An apparatus for surface treating a workpiece comprising:

an elongated housing for containing a bed of treating media, the housing having a floor, spaced apart side walls, and spaced apart end walls;

vibrating means for imparting a vibrating force to the housing having at least a generally vertical force vector sufficient for fluidizing the bed of treating media in the housing;

overhead conveying means located above and extending along the elongated housing for continuously moving the workpieces to be treated through the housing and the fluidized bed of treating media contained therein from one end of the housing to the other end of the housing;

a plurality of workpiece suspension means each having a proximal end and a distal end located at spaced apart intervals along the conveying means, each workpiece suspension means being individually affixed at its proximal end to the conveying means for movement therewith, and depending from the conveyor means for suspending the workpieces positioned at the distal end of each workpiece suspension means from the overhead conveying means into the fluidized bed of treating media contained in the housing;

workpiece supporting means at the distal end of the workpiece suspension means for affixing the workpiees to be treated to the suspension means; and, vibratory isolation means structurally associated with each suspension means for individually isolating each workpiece supporting means, and the workpiece affixed thereto, from the conveying means to allow each workpiece supporting means, and the workpiece affixed thereto, to vibrate due to the excitation thereof by the vibrating bed of surface treating media independently of each other and independently of the conveying means.

2. The apparatus of claim 1, wherein the housing is supported on isolation means.

3. The apparatus of claim 1, wherein the vibrating means is a selectively variable frequency vibrating means providing for selectively varying the frequency of the force generated thereby to the housing.

4. The apparatus of claim 1, wherein the conveying means comprises a conveying path which descends at one end of the housing to a lower elevation above the bed of surface treating media to lower the workpieces into the bed of surface treating media, transverses the housing at the lower elevation with the workpieces submerged in the bed of surface treating media, and ascends at the opposite end of the housing to lift the workpiece out of the bed of surface treating media.

5. The apparatus of claim 1, wherein the vibratory isolation means is selected to cause each of the workpiece supporting means, and the workpiece affixed to the workpiece supporting means suspended from each of the suspension means into the bed of surface treating media to vibrate out of phase with the vibrating bed of surface treating media in the housing.

6. The apparatus of claim 1, wherein the vibratory isolation means is selected to cause each of the workpiece supporting means, and the workpiece affixed to the workpiece supporting means suspended from each of the suspension means into the bed of surface treating media to vibrate in phase with the vibrating bed of surface treating media and at a greater amplitude than the vibrating bed of surface treating media.

7. The apparatus of claim 1, wherein the vibratory isolation means is selected so that the workpiece supporting means, and the workpiece affixed the workpiece supporting means suspended from each of the suspension means into the bed of surface treating media has a resonent frequency approximately matching the frequency of the vibrating means.

8. A method of surface treating a workpiece comprising the steps of:

imparting at least a vertical vibratory force to a stationarily positioned, horizontally oriented, elongated bed of a surface treating media to fluidize the surface treating media;

suspending the workpieces to be treated from an overhead conveyor located over the bed of surface treating media with an intervening vibratory isolation means for individually isolating each workpiece from the conveyor such that the workpieces are submerged in the bed of surface treating media;

allowing the vertically vibrating bed of surface treating media to excite individual vibratory movement in the vertical direction of each workpiece suspended in the bed of surface treating media.

9. The method of claim 8, further comprising:

moving the workpieces on the overhead conveyor at a first elevation to one end of the elongated bed of surface treating media;

lowering the suspended workpieces on the overhead conveyor into the bed of surface treating media at the one end thereof while continuously moving the workpieces on the overhead conveyor;

moving the suspended workpieces generally horizontally through the bed of surface treating media to the opposite end of the elongated bed of surface treating media; and raising the suspended workpieces on the overhead conveyor out of the bed of surface treating media at the opposite end thereof while continuously moving the workpieces on the overhead conveyor.

10. The method of claim 8 comprising the steps of controlling the vibratory isolation means so that the vibrating workpieces vibrate out of phase with the vibrating surface treating media in the vertical direction.

11. The method of claim 8 comprising the step of controlling the vibratory isolation means so that the vibrating workpieces vibrate in phase with the vibrating surface treating media in the vertical direction but at a greater amplitude than the vibrating surface treating media.

12. The method of claim 8 comprising the step of controlling the vibratory isolation means so that the vibrating workpieces vibrate at the resonent frequency approximately matching the frequency of the vertical vibrating force imparted to the bed of surface treating media.

* * * * *